US010369443B2

(12) United States Patent
Gaffney

(10) Patent No.: US 10,369,443 B2
(45) Date of Patent: Aug. 6, 2019

(54) GOLF CLUB HEAD COVER WITH REPOSITIONABLE CLOSURES AND RELATED METHODS

(71) Applicant: J. Travis Gaffney, Phoenix, AZ (US)

(72) Inventor: J. Travis Gaffney, Phoenix, AZ (US)

( * ) Notice: Subject to any disclaimer, the term of this patent is extended or adjusted under 35 U.S.C. 154(b) by 218 days.

(21) Appl. No.: 15/418,443

(22) Filed: Jan. 27, 2017

(65) Prior Publication Data

US 2017/0216693 A1 Aug. 3, 2017

Related U.S. Application Data

(60) Provisional application No. 62/288,037, filed on Jan. 28, 2016.

(51) Int. Cl.
*A63B 60/62* (2015.01)

(52) U.S. Cl.
CPC ..... *A63B 60/62* (2015.10); *A63B 2209/08* (2013.01); *A63B 2209/10* (2013.01)

(58) Field of Classification Search
CPC .. A63B 60/62; A63B 2209/08; A63B 2209/10
See application file for complete search history.

(56) References Cited

U.S. PATENT DOCUMENTS 1,170,486 A * 2/1916 Lethern ..... A45F 5/021 224/660
1,431,032 A * 10/1922 Patzkowski ..... B42F 7/06 224/236
4,356,943 A * 11/1982 Berman ..... A41D 27/20 224/222
5,718,333 A 2/1998 Armour
5,941,293 A 8/1999 Serpa
6,321,805 B1 11/2001 Suggs
6,364,187 B1 * 4/2002 Castellano ..... A45F 5/02 224/236
6,412,674 B1 * 7/2002 Lipke ..... A45C 7/00 224/235
D485,879 S 1/2004 Cameron
8,453,898 B2 * 6/2013 Ewins ..... A45F 5/02 224/675

(Continued)

FOREIGN PATENT DOCUMENTS

GB 1397252 A 6/1975
JP 9084910 A 3/1997

OTHER PUBLICATIONS

International Search Report, PCT Patent Application No. PCT/US2017/015521, dated May 25, 2017, 2 pages.

(Continued)

*Primary Examiner* — Tri M Mai
(74) *Attorney, Agent, or Firm* — IPTechLaw

(57) ABSTRACT

Implementations of golf club head covers may include a body portion defining an internal cavity for receiving a golf club head, the internal cavity exposed at an opening in the body portion, a flap coupled to the body portion and configured to cover the opening of the body portion, a guide strip coupled to the flap, a strap holder configured to move along the guide strip slidably coupled to the guide strip, and a strap coupled at an end of the strap holder, wherein the strap is configured to secure the flap over the opening through coupling to a front face of the body portion.

12 Claims, 11 Drawing Sheets

(56) References Cited

U.S. PATENT DOCUMENTS

| | | | | |
|---|---|---|---|---|
| 9,314,093 | B2 * | 4/2016 | Heien | A45F 5/021 |
| 2006/0287122 | A1 | 12/2006 | Ray | |
| 2007/0068611 | A1 | 3/2007 | Hwang | |
| 2009/0188593 | A1 | 7/2009 | Cameron | |
| 2009/0242089 | A1 | 10/2009 | Gaffney | |
| 2011/0048596 | A1 | 3/2011 | Low | |
| 2015/0351571 | A1 * | 12/2015 | Johnson | A45F 5/00<br>224/250 |

OTHER PUBLICATIONS seemore.com, "Black SB Headcover w/Pocket Velcro Closure", Apr. 12, 2013, Publisher: http://www.seemore.com/accessories/headcovers/sb-head-covers-rh-only/right-hand-black-sb-head-cover-w-pocket-velcro-closure.html, Published in: U.S.

Pro-Tekt, "Golfers Club Pro Tekt Neoprene Velcro Iron Covers", Apr. 12, 2013, Publisher: http://www.golfgeardirect.co.uk/shop/accessories/golf-headcovers/golfers-club-headcovers/golfers-club-pro-tekt-neoprene-1034586.html, Published in: U.S.

Photo of golf club head cover, available as early as Jan. 28, 2016.

* cited by examiner

GOLF CLUB HEAD COVER WITH REPOSITIONABLE CLOSURES AND RELATED METHODS

CROSS REFERENCE TO RELATED APPLICATIONS

This document claims the benefit of the filing date of U.S. Provisional Patent Application 62/288,037, entitled "Golf Club Head Covers with Repositionable Closures and Related Methods" to John Travis Gaffney which was filed on Jan. 28, 2016, the disclosure of which is hereby incorporated entirely herein by reference.

BACKGROUND

1. Technical Field

Aspects of this document relate generally to sporting equipment, particularly golf clubs.

2. Background

Conventionally, golf head covers are used while the various clubs required to play golf are carried in a bag or cart. Various golf head cover types and designs are disclosed in U.S. Pat. No. 8,276,627 to Gaffney entitled "Golf Club Head Cover with Snap Closure" issued on Oct. 2, 2012, in U.S. Patent Application Publication No. 2011/0265922 to Gaffney entitled "Golf Club Head Cover" published on Nov. 3, 2011, in U.S. Pat. No. D624,980 to Gaffney entitled "Golf Club Head Cover" issued on Oct. 5, 2010, and in U.S. Pat. No. D710,960 to Gaffney entitled "Golf Club Head Cover" issued on Aug. 12, 2014, the disclosures of each of which are hereby incorporated entirely herein by reference.

SUMMARY

Implementations of golf club head covers may include a body portion defining an internal cavity for receiving a golf club head, the internal cavity exposed at an opening in the body portion, a flap coupled to the body portion and configured to cover the opening of the body portion, a guide strip coupled to the flap, a strap holder configured to move along the guide strip slidably coupled to the guide strip, and a strap coupled at an end of the strap holder, where the strap is configured to secure the flap over the opening through coupling to a front face of the body portion.

Implementations of golf club head covers may include one, all, or any of the following:

The front face may include a recess along an open edge of the front face.

The front face may include a re-entrant opening in an open edge of the front face.

The strap may include a magnet and the front face may include one or more magnets therein, wherein the magnet of the strap is configured to magnetically couple to the one or more magnets of the front face.

The magnet of the strap may be included in the strap and the one or more magnets of the front face may be included in a pocket, wherein the pocket is coupled in the front face, coupled on an outside of the front face, or coupled on an inside of the front face The magnet of the strap may be within the strap and the one or more magnets of the front face may be slidably retained within a pocket, where the pocket is coupled in the front face, on the outside of the front face, or on the inside of the front face.

The guide strip may be a cylindrical guide strip.

The strap may be configured to secure to a front face of the body portion using hook and loop fasteners.

Implementations of golf club head covers may include a body portion defining an internal cavity for receiving a golf club head, the internal cavity exposed at an opening in the body portion, wherein the body portion includes a front face comprising a strip of hook and loop fasteners extending across a portion of the front face, a flap coupled to body portion and configured to cover an opening of the body portion, a guide strip coupled to the flap, a strap holder configured to move along the guide strip slidably coupled to the guide strip, and a strap coupled to the end of the strap holder comprising a patch of hook and loop fasteners. The patch of hook and loop fasteners may be configured to secure to a plurality of locations along the strip of hook and loop fasteners of the front face.

Implementations of golf club head covers may include one, all, or any of the following:

The front face may include a recess along an open edge of the front face.

The front face may include a re-entrant opening in an open edge of the front face.

The guide strip may be a cylindrical guide strip.

Implementations of golf club head covers may include a body portion defining an internal cavity for receiving a golf club head, the internal cavity exposed at an opening in the body portion, a flap coupled to the body portion and configured to cover the opening of the body portion, wherein the flap or the body portion include a pocket, and a strap removably attached within the pocket, where the strap is configured to secure the flap over the opening by coupling to a front face of the body portion.

Implementations of golf club head covers may include one, all, or any of the following:

The pocket may be reclosable.

An opening of the pocket may be at a leading edge of the flap.

An opening of the pocket may be at an intersection between the flap and the body portion.

The strap may be configured to removably attach within the pocket using hook and loop fasteners.

The strap may be configured to couple to a front face of the body portion using hook and loop fasteners.

The front face may include a recess along an open edge of the front face.

The front face may include a re-entrant opening in an open edge of the front face.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended golf club head cover will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such golf club head covers, and implementing components and methods, consistent with the intended operation and methods.

Figure 1:
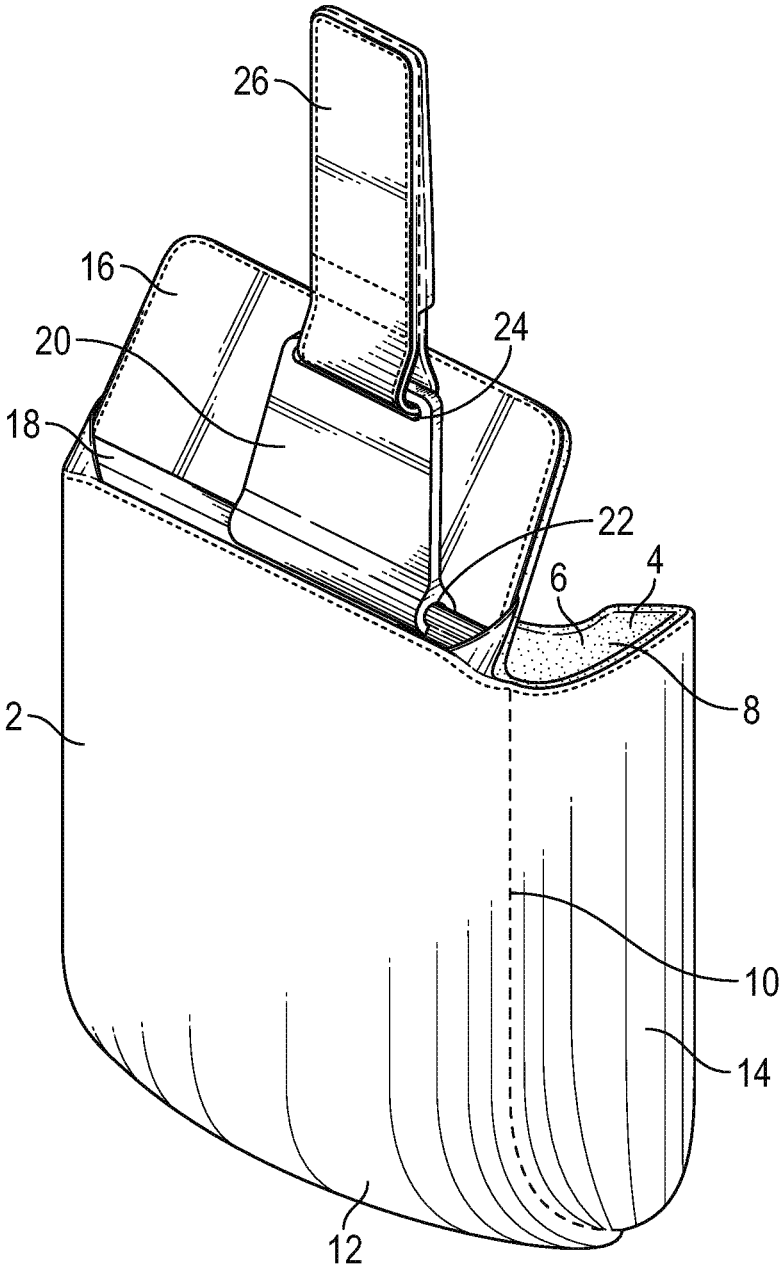
FIG. 1 is a perspective view of a golf club head cover implementation.

Referring to FIG. 1, a perspective view of a golf club head cover is illustrated. The golf club head cover includes a body portion 2. The outside of the body portion may be made from, by non-limiting example, real leather, artificial leather, a polymer material, fabric, fur, or any combination thereof. In various implementations the inside 4 of the body portion 2 may be lined with fur, a fur-like material, a low-friction material or fabric, or any combination thereof. In various other implementations, the inside 4 of the body portion 2 may have no liner or may be lined with a cloth fabric material. In various implementations, the body portion 2 may contain additional padding, such as foam, between the outside of the body portion and the inner liner. In these implementations, the padding may include one, two, or more layers of various materials, including fabrics, foams, or fur-like materials, depending on the implementation.

The body portion 2 defines an internal cavity 6 that is exposed at an opening 8 of the body portion. The opening 8 is created through the structure of the body portion 2 and allows the user to access the interior of the body portion (the internal cavity 6) through the opening 8 when attempting to insert a golf club head (such as a putter) therein. The body portion 2 has a shape that allows golf club heads to be received therein. While the head cover illustrated in FIG. 1 illustrates a golf club head cover designed to fit putters, various implementations of the golf club head cover may be designed to fit various other golf club head types, such as, by non-limiting example, hybrids, irons, woods, drivers and other golf club head types. In the illustrated implementations of the golf club head cover only a single seam 10 is shown that sews together the two pieces of material 12 and 14 that form the body portion 2, however, in various implementations more or less seams could be used to form the body portion and any number of pieces of material could be used to form the body portion. Further, in other implementations other coupling mechanisms could be used to couple the various portions of the head cover, such as, by non-limiting example, glue, bonding, a heat weld, and any other method or technique for coupling various fabric or leather-like materials together. In various implementations, the various portions could be integrally formed instead of being formed separately. Embroidery may be included on any portion of the head cover, as with other head covers. These implementations, the embroidery may be applied to the head cover portion before it is fully assembled.

The golf club head cover may include a flap 16. The flap 16 may be a continuation of the body portion 2 or it may be a separate piece of material that is attached to the body portion 2. The flap may be made from the same materials as the body portion 2 or from different materials. Furthermore, the inner side of the flap may include the same inner lining material as the body portion or it may contain a different, or no inner lining material. As illustrated in FIG. 1, the flap 16 is in an open position and the internal cavity 6 is accessible to receive a golf club head through the opening 8. The flap 16 may be opened and closed (reclosable). In various implementations the size and shape of the flap corresponds to the size and shape of the opening 8, however, in other implementations the flap may be smaller than or greater than the size/dimensions of the opening 8.

The golf club head cover may include a guide strip 18. In various implementations the guide strip is located on the flap. In such implementations, the guide strip may be located at a front edge of the flap, at a rear portion of the flap, or at any position in between. The guide strip 18 may extend across the entire length of the flap 16 or any portion thereof. In other implementations, the guide strip may be located on the body portion 2 of the golf club head cover.

As illustrated in FIG. 1, the guide strip is closed at each end of the guide strip, not allowing the flap to travel off of the guide strip. However, in various implementations the guide strip may be opened at one or both ends of the guide strip 18, allowing the flap to travel off of the guide strip. In such implementations, a locking, latching, clipping, or other securing mechanism may be included that prevents the flap from traveling off of the end(s) of the guide strip while the head cover is in use.

As illustrated in FIG. 1, the guide strip may be cylindrical or substantially cylindrical in various implementations. The guide strip 18 may be formed by sewing a cloth material around a rigid or semi-rigid cylindrical element. The rigid or semi rigid element may be, by non-limiting example, a polymeric cylinder, a cord or rope, a metal cylinder, a wooden cylinder or dowel, or any other rigid or semi-rigid material with a desired cross-sectional shape. In various implementations other mechanisms and/or materials may be used to form the guide strip 18, such as by non-limiting example, where the guide strip is integrally formed from a single material rather than being enclosed in cloth. In various implementations the guide strip may not be cylindrical but may have a cross sectional shape that is different, such as, by non-limiting example, elliptical, rectangular, square, triangular, trapezoidal, irregular or any other closed shape.

The golf club head cover may include a strap holder 20 coupled to the guide strip in various implementations, though in some implementations, the strap is directly coupled to the guide strip 18. The strap holder may include a cavity 22 configured to receive a portion of the guide strip 18. In such implementations, cavity 22 may "snap" or tightly slidably engage over the guide strip 18 via an opening along the length of the strap holder 20 that allows the guide strip 18 to enter the cavity 22. In such implementations the diameter of the guide strip 18 may be somewhat larger than the width of the opening of the cavity 22, but the guide strip and/or opening may be formed of materials(s) that allow the guide strip to compress or the opening to be widened temporarily so that the guide strip may be snapped or tightly slidably engaged into the cavity 22. In various implementations where the ends of the guide strip are not closed, a strap holder may be inserted over the open end(s) of the guide strip at an end of the cavity 22 of the strap holder 26 rather than through "snapping" the cavity 22 over the guide strip 18.

In various implementations the diameter of the cavity 22 is somewhat greater than the diameter of the guide strip 18. This allows for the strap holder 20 to slide along the guide strip 18 during operation. In various implementations the fit of the guide strip 18 in the cavity 22 is tight resulting in sufficient friction to prevent the strap holder from sliding along the guide strip while the golf club head cover is being carried, jostled, or bumped. The amount of pressure and friction between the guide strip 18 and the cavity 22 depending on the relative sizing of the size of the guide strip 18 and the cavity 22 may still allow for a user to apply the sufficient force to slidably move the strap holder 20 along the guide strip 18. In other implementations, the material that covers the guide strip 18 may be selected to have a thickness and or surface roughness/frictional characteristic that is used to control the movement of the guide strip 18 through the cavity 22 and the movement of the strap holder 20 along the guide strip 18.

Figure 4:
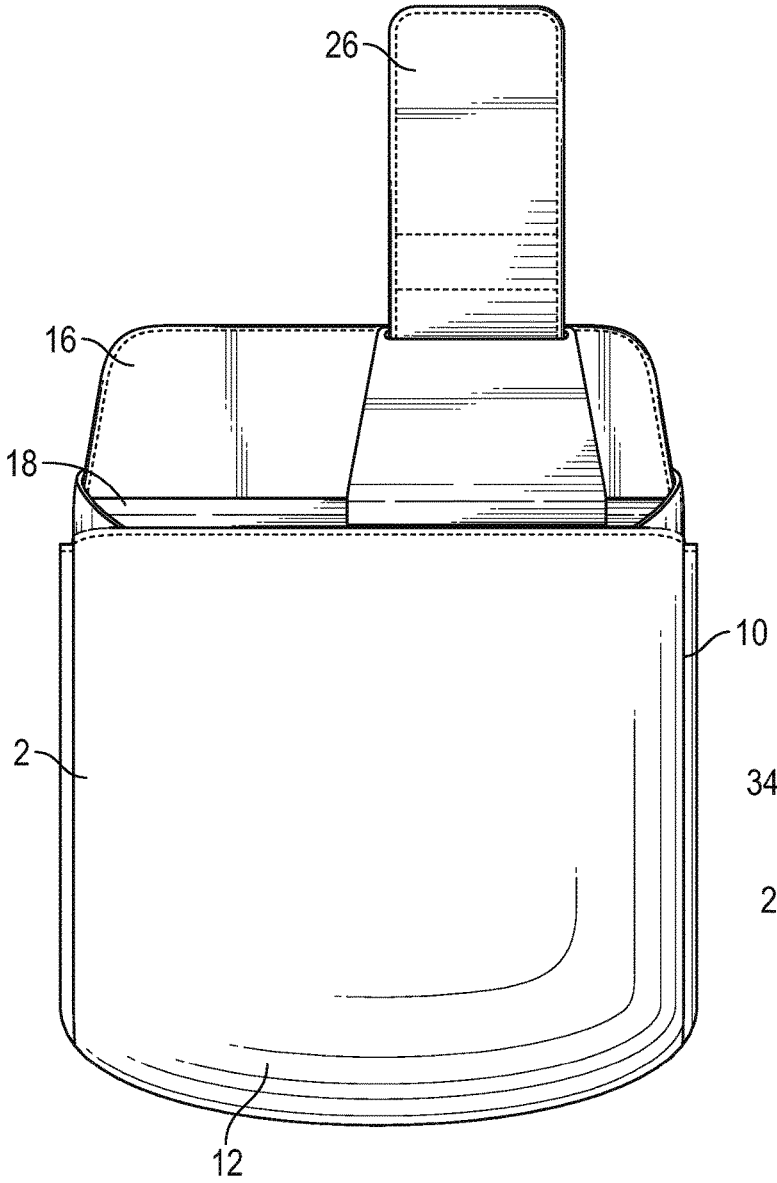
FIG. 4 is a rear view of a golf club head cover implementation.

The strap holder 20 may have a variety of shapes and sizes. In FIG. 1 the strap holder 20 is illustrated as a trapezoid with the cavity 22 located at the long edge of the trapezoid. This can be even more clearly seen in FIG. 4 which shows a rear view of the golf club head cover. In various implementations the cavity 22 may be located at the short edge of the trapezoid or the strap holder 20 may be, by non-limiting example rectangular, square, or any other regular or irregular closed shape. The strap holder may be as long as the guide strip 18 or as short as any portion of the guide strip. In various implementations, the strap holder 20 is at least as tall as the flap 16, however, in various implementations strap holder 20 may be shorter or taller than the height of the flap 16. In some implementations, no strap may be used, but just a strap holder may be used.

The strap holder may be formed of a rigid or substantially rigid polymer material. In other implementations it could be formed of a metal, a composite, a wooden material, and so forth.

In various implementations the strap holder 20 includes a slit 24 therethrough at an end of the strap holder opposite the portion of the strap holder that couples to the guide strip 18. The slit 24 may be shaped in various ways, and may be any a closed shape of varying sizes and dimensions that fits within the boundaries of the strap holder of varying sizes.

Figure 5:
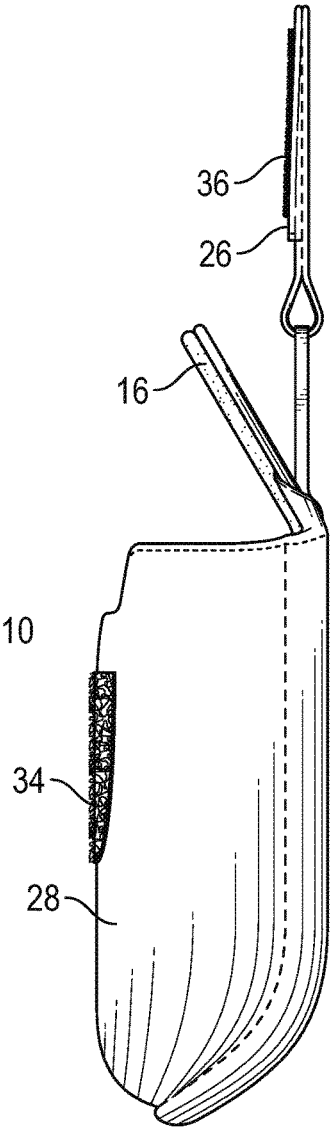
FIG. 5 is a is a side view of a golf club head cover implementation.

The golf club head cover includes a strap 26. In implementations including a strap holder, the strap 26 may be coupled to the strap holder 20 in somewhat of a hinged or rotatable manner so that the strap can rotate about the strap holder. The strap may be coupled to the strap holder by passing through the slit 24 of the strap holder 20. This can be clearly seen in FIG. 5 which is a side view of the golf club head cover. In various implementations, the strap may be coupled to the strap holder through various coupling mechanisms including, by non-limiting example, snapping, sewing, gluing, bonding, or any other method or system for coupling flexible materials together. The strap 26 may be configured to secure the flap 16 over the opening 8 through coupling to a front face of the body portion 2 as further described herein.

Figure 2:
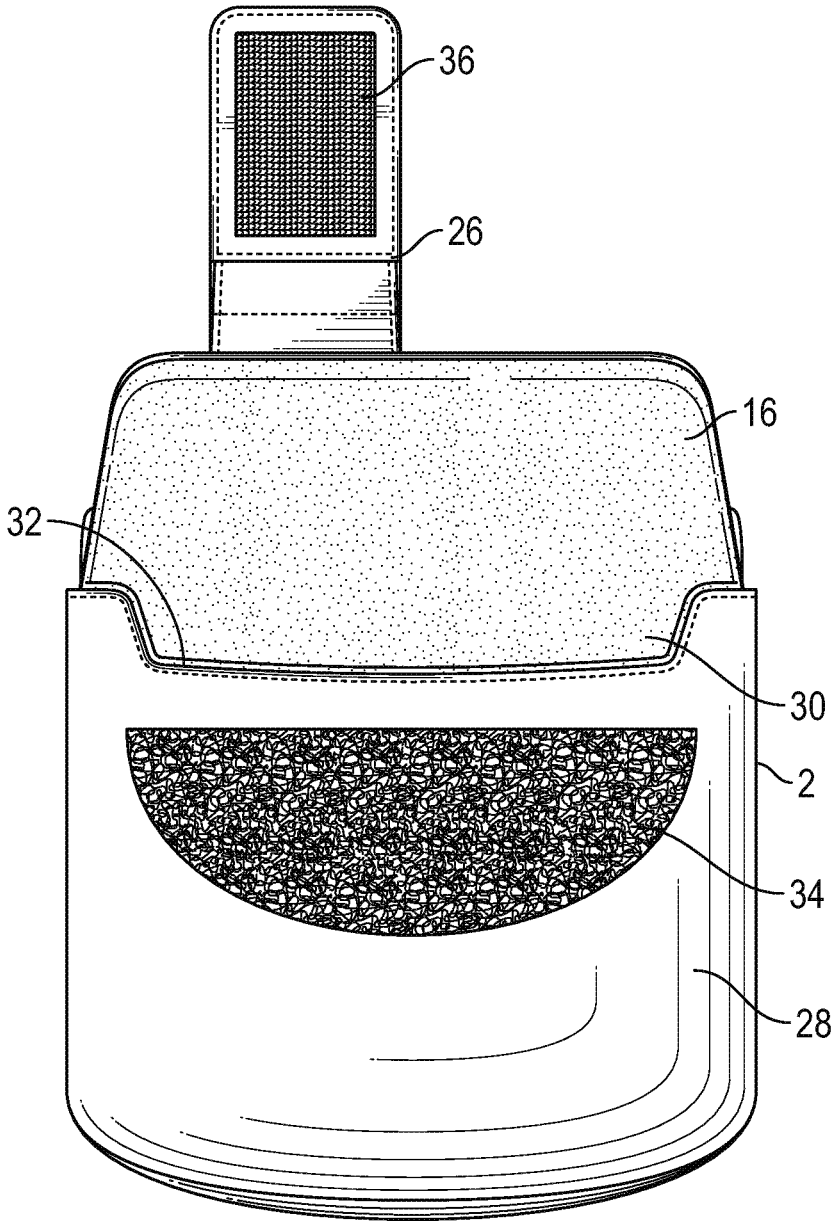
FIG. 2 is a front view of a golf club head cover implementation with hook and loop fasteners.

Referring now to FIG. 2, a front view of a golf club head cover with hook and loop fasteners is illustrated. The body portion 2 includes a front face 28. The front face may include a recess 30 along an open edge 32 of the front face 28. The recess 30 may also be described as a re-entrant opening in an open edge 32 of the front face 28 which begins, extends into the open edge 32, and then terminates on the same open edge 32. This recess may facilitate the use of the head covers as it better allows for a golf club shaft to extend from the golf club head cover with the flap 16 in a closed position no matter the particular orientation of the golf club shaft. In various implementations the recess 30 may be more or less shallow or more or less wide than the recess illustrated in FIG. 2.

Figure 3:
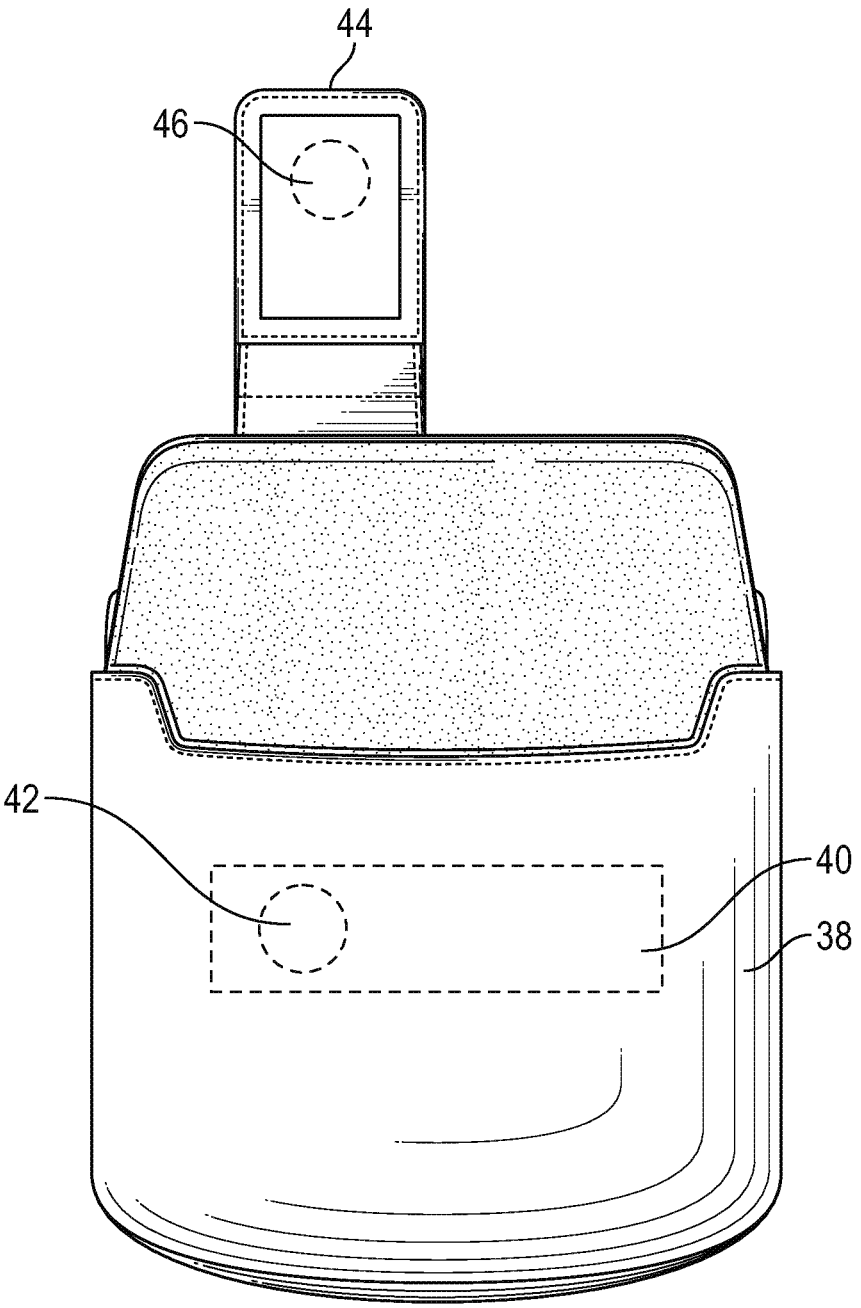
FIG. 3 is a front view of a golf club head cover implementation with magnets.

The front face includes a structure that allows for the strap to be coupled to the front face. In FIG. 3, a strip of hook and loop fasteners 34 is illustrated. The strip of hook and loop fasteners 34 may extend across the entire length of the front face or any portion of the front face 28. In implementations where the strip of hook and loop fasteners 34 are used, the strap 26 may also include a portion of hook and loop fasteners 36 attached to the front of the strap 26. The portion of hook and loop fasteners 36 and the strip of hook and loop fasteners 34 may be positioned so that the portion of hook and loop fasteners 36 couples to the strip of hook and loop fasteners 34 when the golf club head cover is in a closed position.

In other implementations, a magnetic closure mechanism is used rather than the hook and loop fasteners. Referring now to FIG. 3, a front view of a golf club head cover with magnets is illustrated. The golf club head cover includes a front face 38 which may include a pocket 40. In various implementations the pocket may be coupled to the outer surface of the front face 38, the inner surface of the front face 38, or within the front face 38.

In various implementations the pocket 40 includes a single magnet 42. In such implementations, the magnet is slidably retained in the pocket 40. The magnet 42 in the pocket 40 may be housed in an additional housing, such as a plastic casing or body, or it may not include any kind of housing within the pocket. In other implementations the pocket 40 may include two or more magnets. The two or more magnets may be retained within the pocket 40. The two or more magnets may be included in a housing within the pocket, such as a plastic mold, to prevent the magnets within the pocket from sticking to one another. In other implementations, the pocket 40 may be sectioned and include a magnet in each section preventing the magnets from sticking to one another. Any of the various casing or body designs disclosed in U.S. Pat. No. 8,905,094 to Travis Gaffney entitled "Golf Club Head Cover," issued Dec. 9, 2014, the disclosure of which is hereby incorporated entirely herein by reference, may be employed in various head cover implementations disclosed herein.

In implementations where magnets are used on the front face, the strap 44 also includes a magnet 46 oriented in a complementary or corresponding way to the magnet(s) of the front face. The magnet 46 may be within the strap 44 or on the inner face of the strap 44. The magnet 46 may be within a housing, such as a plastic mold which may be any disclosed in this document. In other implementations the magnet 46 without any kind of housing may be fixed to the strap 44 using a metallic housing or other housing design that may be coupled, sewn, glued, or otherwise attached to the material of the strap 44.

The magnet 46 and the magnet 42 are positioned in a way that allows for the magnet 46 to couple to magnet 42 when the golf head cover is in a closed position. In various implementations, this may be accomplished by the user identifying the desired position of the magnet 42 in the pocket 40 based on the location of the golf club shaft and then the user tapping (via tapping the cover itself), sliding (either through gravity force, magnetic force, or through a slider physically or magnetically coupled to the magnet 42 that is located on the front face 38 of the cover), or otherwise guiding the magnet 42 to the desired position. The magnet 46 is then positioned in the corresponding location as the magnet 42 to allow the two magnets to magnetically couple. In this way, the user is able to adjust the position of the strap 44 to allow the head cover to accommodate various different combinations of shaft orientations relative to various golf club head orientations.

In various other head cover implementations, other coupling mechanisms may be used to couple the strap to the front face of the golf club head cover, including, by non-limiting example, snaps, buttons, clips, buckles, or any other coupling mechanism.

Figure 6B:
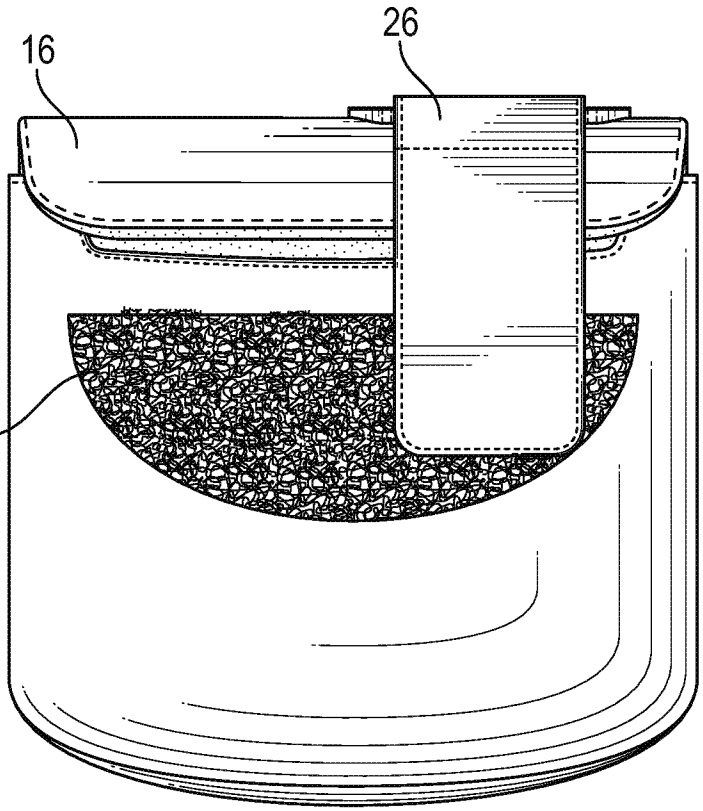
FIGS. 6A-6B are views of a golf club head cover implementation in different closed positions.
Figure 6A:
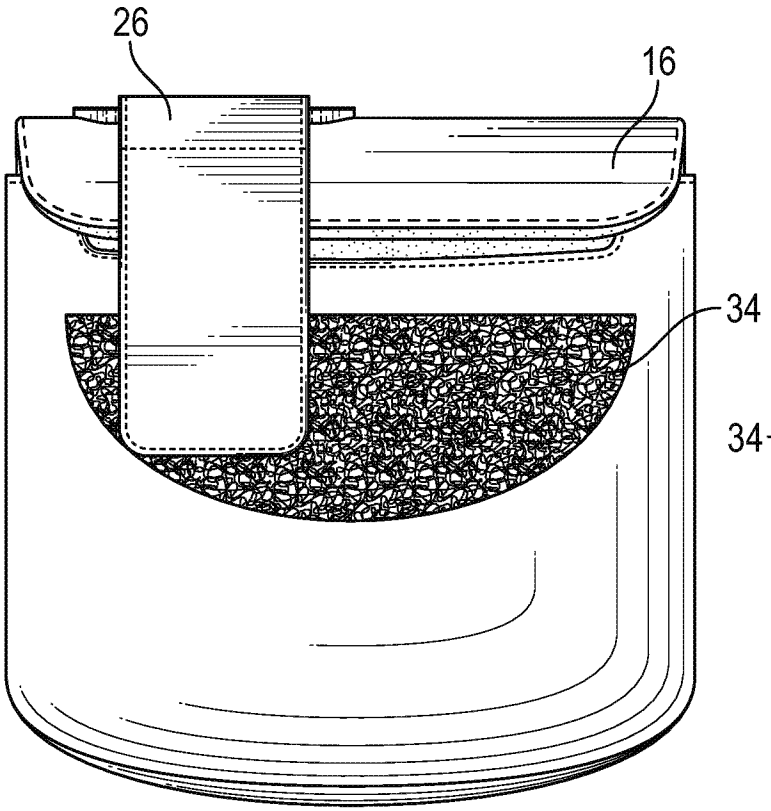

Referring now to FIGS. 6A-6B, views of a golf club head cover in different closed positions are shown. FIG. 6A illustrates a golf club head cover in a closed position with the strap 26 coupled to the strip of hook and loop fasteners 34 on a left side of the golf club head cover. FIG. 6B illustrates a golf club head cover in a closed position with the strap 26 coupled to the strip of hook and loop fasteners 34 on a right side of the golf club cover. By altering the position of the strap 26, a single golf club head cover can be used for a variety of golf clubs, including both right and left handed golf clubs.

Figure 7C:
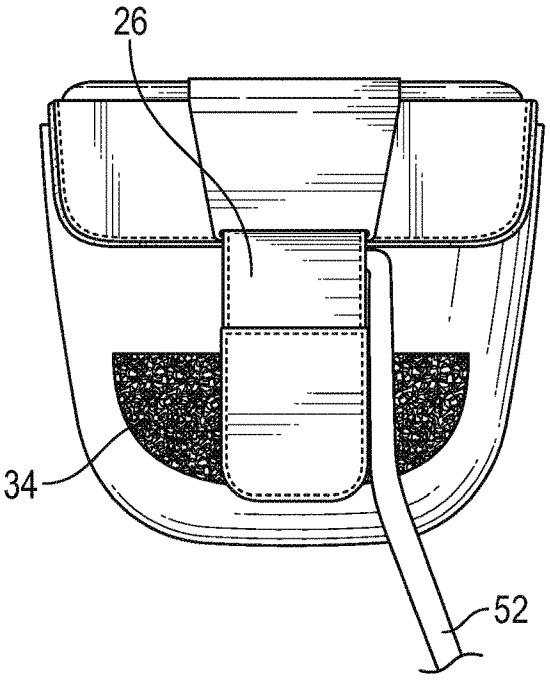
FIGS. 7A-7C are views of a golf club head cover implementation used with various putters with shafts having varying orientations showing the strap oriented to accommodate each shaft orientation.
Figure 7B:
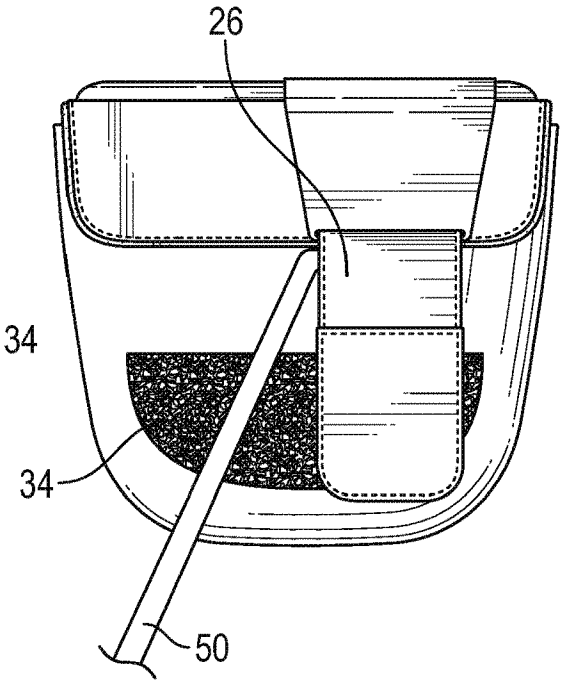
Figure 7A:
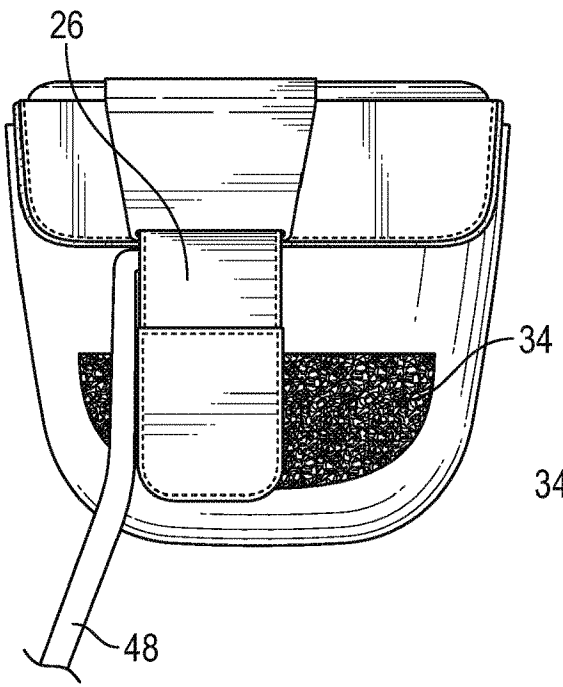

Referring now to FIGS. 7A-7C, views of a golf club head cover in use with a golf club shaft located in varying positions are illustrated. FIG. 7A illustrates a golf club head cover in use with a putter that has the shaft of the golf club located on the right side of the head of the putter. The strap 26 is coupled to the strip of hook and loop fasteners 34 in a manner that allows the shaft 48 of putter to freely extend substantially perpendicularly from the front face of the golf club head cover. FIG. 7B illustrates another implementation of the golf club head cover in use with a putter with a shaft that is substantially centered on the head of the putter. The shaft 50 of the golf club in this implementation also extends substantially perpendicularly from the front face of the golf club head cover at a different position than shaft 48 of FIG. 7A. As illustrated, the strap 26 is moved to a location to allow the strip of hook and loop fasteners 34 to be positioned to allows for the shaft 50 of the golf club to freely extend from the golf club head cover while retaining the head cover over the putter. FIG. 7C illustrates an implementation of the golf club head cover in use with a putter with a shaft that is located on the left side of the head of the putter. As mentioned previously, as is illustrated, the strap 26 is coupled to the strip of hook and loop fasteners 34 in a manner that allows the shaft 52 of a left handed golf club to freely extend substantially perpendicularly from the front face of the golf club head cover. In various implementations, the strap 26 may couple to the strip of hook and loop fasteners in any number of different positions, thus allowing for the golf club head cover to accommodate wide variety of different golf club head and shaft orientations and sizes.

Figure 8:
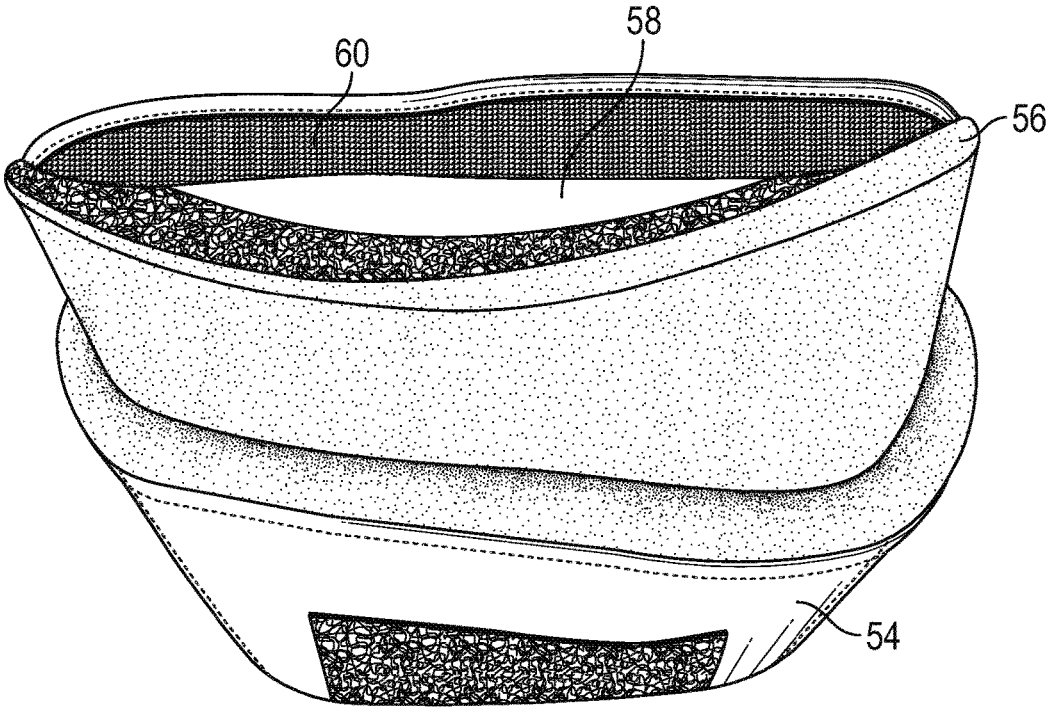
FIG. 8 is a top view of a golf club head cover implementation with a pocket in the flap.

Referring now to FIGS. 8-11, another implementation of a golf club head cover is illustrated. Referring specifically to FIG. 8, a top view of a golf club head cover with a pocket in the flap is illustrated. The golf club head cover includes a body portion 54. The body portion may be any type of body portion disclosed in this document. The golf club head cover also includes a flap 56. The flap may also be any type of flap disclosed herein. Further, the golf head cover may include a pocket 58. The pocket 58 may be in the body portion 54 or the flap 56. In implementations where the pocket 58 is in the flap, an opening of the pocket 58 may be at a leading edge of the flap 56 as shown in FIG. 8. In other implementations the opening of the pocket may be located at a line of/point of intersection between the flap and the body portion. In various implementations the pocket is as wide as the golf club head cover or as wide as any portion thereof, including the flap.

The pocket 58 illustrated in FIG. 8 is reclosable. It may be reclosable using a variety of closing mechanisms. As illustrated in FIG. 8, a strip of hook and loop fasteners 60 may extend along an inner edge of the opening. Other reclosable mechanisms that may be used in various implementations, including, by non-limiting example, magnets, snaps, clips, or any other reversibly openable and closable mechanism.

Figure 9:
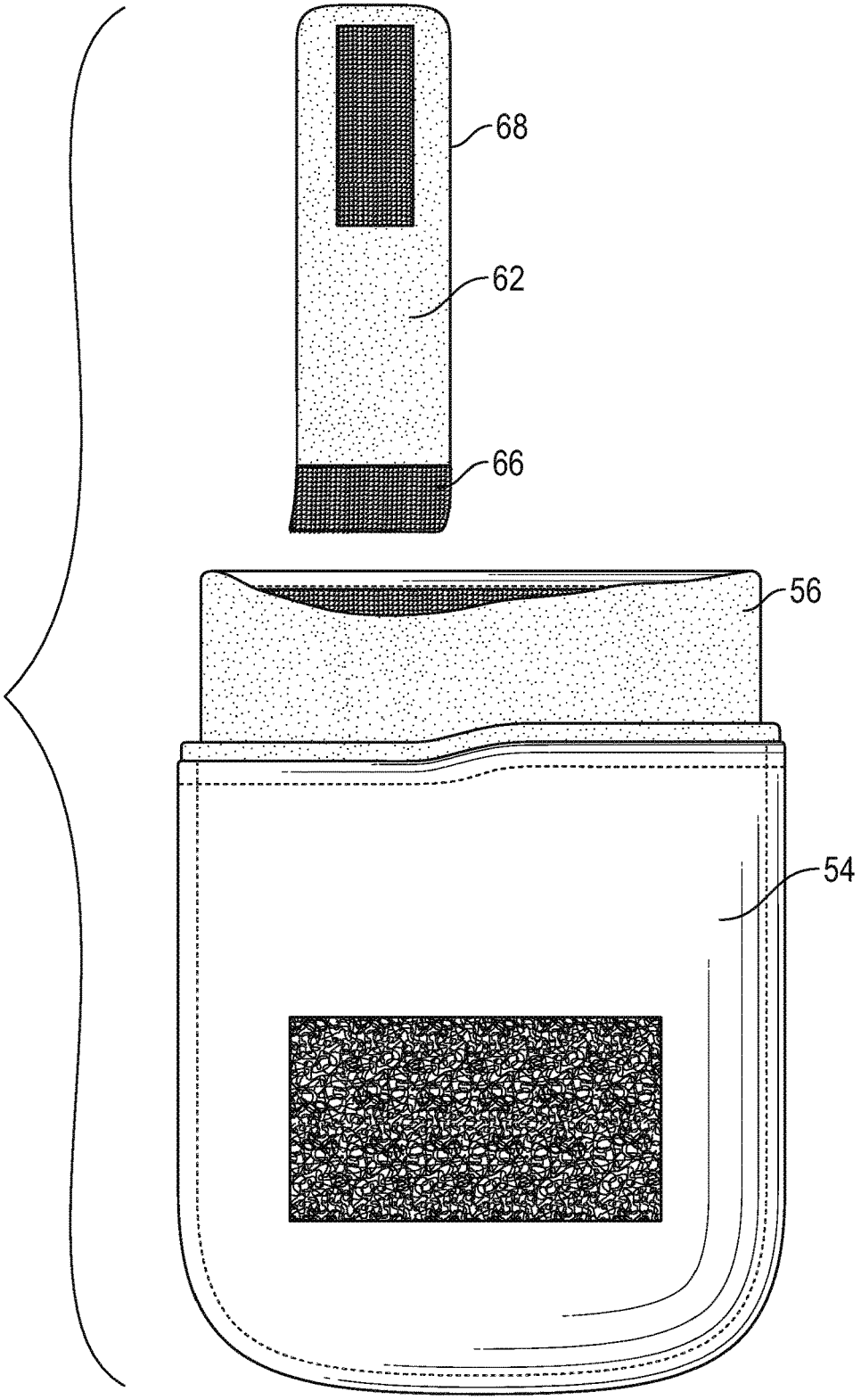
FIG. 9 is a front view of a golf club head cover implementation with the strap separated from the rest of the head cover.

Referring now to FIG. 9, a front view of a golf club head cover with the strap separated from the rest of the head cover is shown. The strap 62 is removable from the rest of the golf club head cover. The strap 62 may include an attachment mechanism at the base of the strap 66, at the top of the strap 68, or both at the top and the base of the strap. As illustrated in FIG. 9, the strap 62 includes hook and loop fasteners at both the top and the base of the strap. In various implementations, other attachment mechanisms may be used to removably attach the top and base of the strap to the flap or body portion, such as, by non-limiting example, snaps, buttons, hooks, clasps, magnets, or any other coupling or attachment mechanism disclosed herein.

Figure 10:
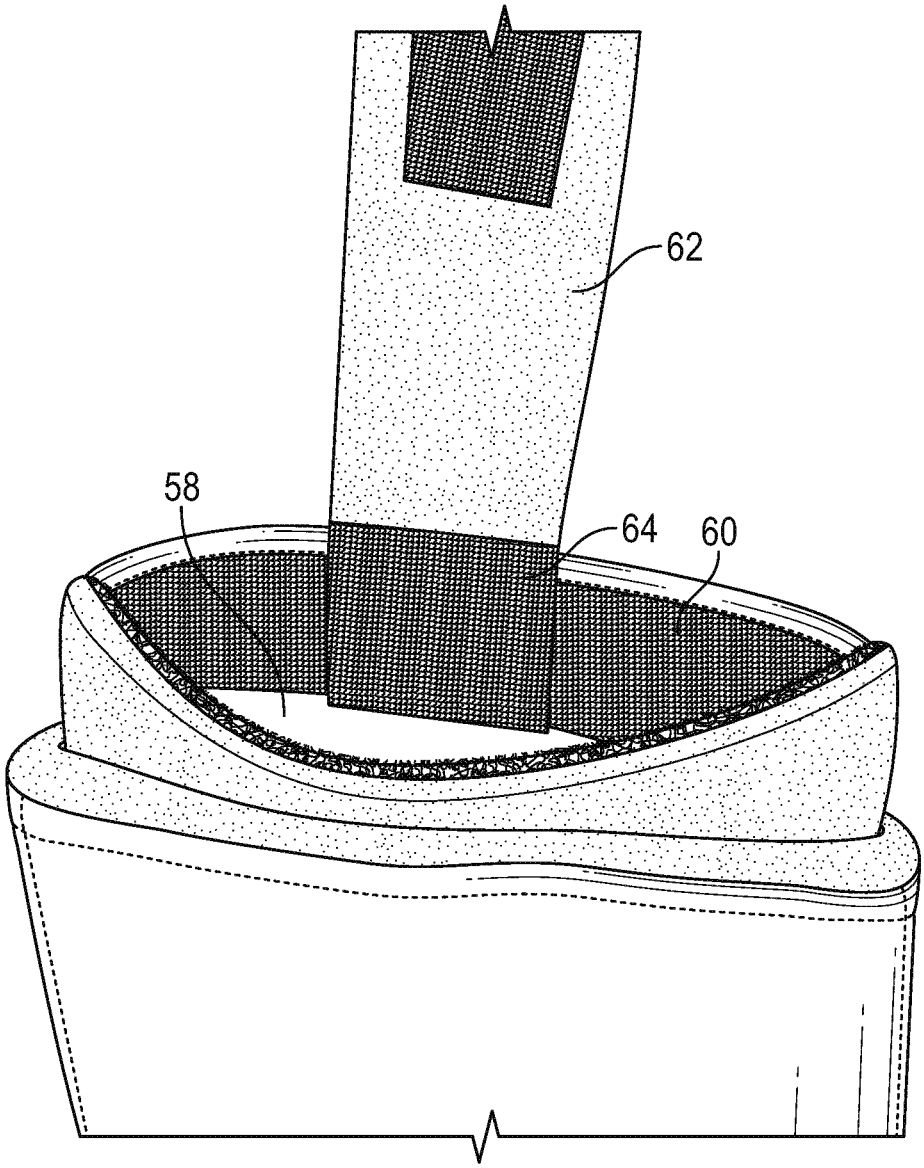
FIG. 10 is a magnified view of the strap implementation shown in FIG. 9 attaching within a pocket in the flap of the golf club head cover implementation illustrated in FIG. 8.

Referring now to FIG. 10, a magnified view of the strap shown in FIG. 9 coupled within a pocket in the flap of the golf club head cover shown in FIG. 8 is illustrated. The strap 62 may removably attach to any portion of the pocket 58. In the implementation illustrated by FIG. 10, the strap 62 has a patch of hook and loop fasteners 64 at the base of the strap that allows the strap to be removably attached within the pocket. In various implementations, other attachment mechanisms may be used to removably attach the strap to the flap or body portion, such as, by non-limiting example, snaps, buttons, hooks, clasps, and magnets. The pocket 58 may close over the strap 62 to further secure the strap in the pocket.

Figure 11:
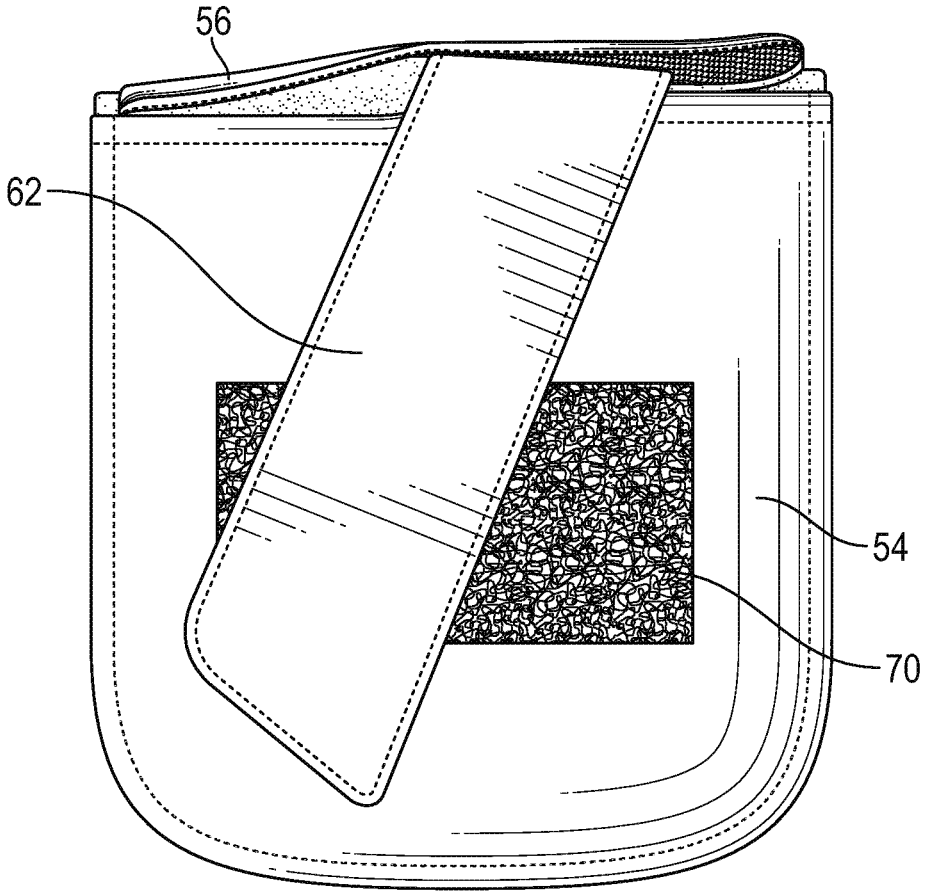
FIG. 11 is a view of the golf club head cover implementation illustrated in FIGS. 8-10 in a closed position.

Referring now to FIG. 11, a view of the golf club head cover shown in FIGS. 8-10 in a closed position is illustrated. The body portion 54 of the golf club head cover includes a front face as has been disclosed herein in various implementations of the golf club head cover. The front face may include an attachment mechanism 70 to facilitate the coupling of the strap to the body portion which closes flap 56 over the opening. The coupling mechanism on the front face may be any coupling mechanism on a front face of the body portion that has been disclosed in this application. The strap 62 may attach to various locations of the coupling mechanism 70, thus allowing the strap to extend diagonally across the front face or straight down the front face.

The ability of the strap 62 to be attached at any location within the pocket and then attached straight across or diagonally (as illustrated in FIG. 11) to the front face of the head cover allows the user to arrange the strap 62 to permit it to hold the cover over a golf club head taking into account a wide variety of possible positions of the golf club shaft. In this way, the user can position the strap 62 in the pocket 58 and then attach the strap 62 to the front face for a golf club having a shaft attached to the head in a first orientation. The user can then rearrange the position of the strap 62 to a different location in the pocket to allow the same golf club head cover to be coupled over a shaft attached to the head in a second orientation different from the first orientation. A wide variety of combination of strap positions and strap attachment points to the front face are possible and so many different golf club heads with different shaft positions can be accommodated using a single head cover.

Figure 12:
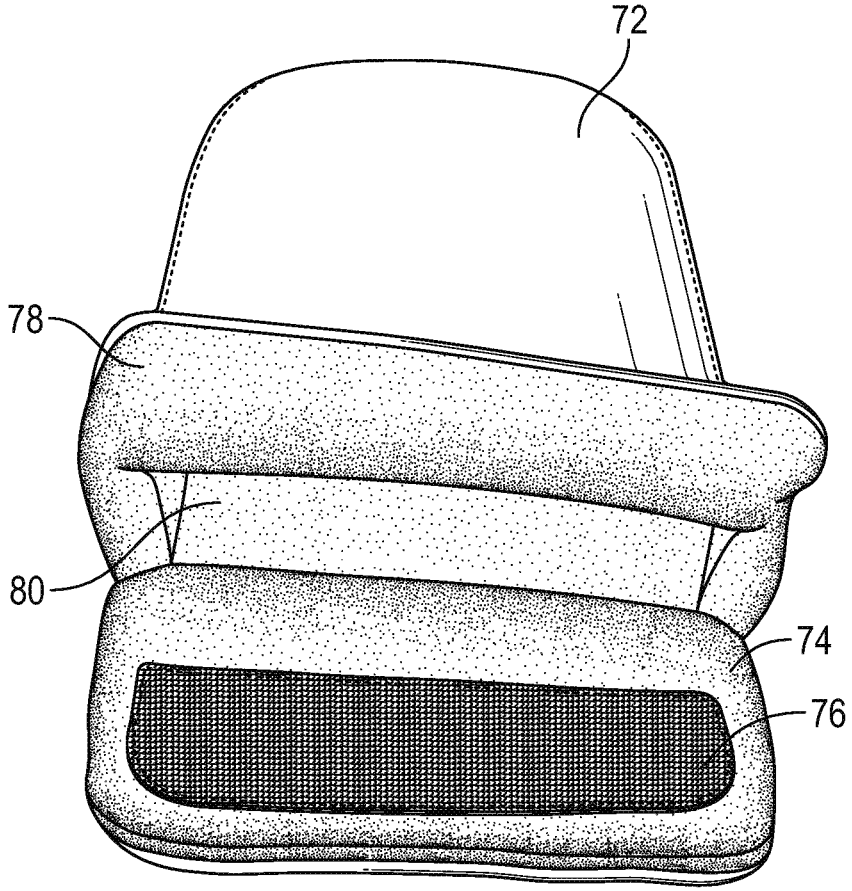
FIG. 12 is a perspective view of a particular golf club head cover implementation that does not utilize a strap.

Referring to FIG. 12, a perspective view of a particular golf club head cover that does not utilize a strap is illustrated. The golf club head cover includes a body portion 72 that may be the same as other body portions disclosed in this application. The golf club head cover also includes a flap 74. The flap may be a continuation of the same material from the body portion, or it may be a separate piece of material as illustrated in FIG. 12. The strap may also include a coupling mechanism 76 utilized to close the flap over the opening 80. In the illustrated implementation the coupling mechanism 76 is a strip of hook and loop fasteners, however, in various implementations the coupling mechanism may include, by non-limiting example, snaps, magnets, buttons, hooks, clasps, zippers, or any combination thereof.

The golf club head cover illustrated in FIG. 12 also may include a second flap 78. This flap may be smaller than flap 74, however, in various implementations it is the same size or larger than flap 74. Flap 74 may be configured to fold over the opening 80 and couple to the second flap 78, securing a golf club head inside the body portion. In various implementations the second flap 78 may also include a coupling mechanism, such as hook and loop fasteners or any other mechanism disclosed herein to facilitate the coupling of flap 74 to flap 78, however, in other implementations, as illustrated, the coupling mechanism 76 is sufficient to couple flap 74 to flap 78 without additional coupling mechanisms on flap 78. This implementation allows the user, through the complementarily arranged hook and loop fasteners to close the cover down directly over the shaft of the golf club regardless of where the shaft of the golf club happens to be oriented/positioned between flap 74 and flap 78.

Additional examples of golf club head cover implementations utilizing the principles disclosed herein are illustrated in U.S. Design patent application Ser. No. 29553147 to J. Travis Gaffney entitled "Golf Club Head Cover With Closure," filed Jan. 28, 2016; U.S. Design patent application Ser. No. 29591993 to J. Travis Gaffney entitled "Golf Club Head Cover With Closure," filed Jan. 25, 2017; and U.S. Design patent application Ser. No. 29591996 to J. Travis Gaffney entitled "Golf Club Head Cover With Closure," filed Jan. 25, 2017, the disclosures of each of which are hereby incorporated entirely herein by reference.

In places where the description above refers to particular implementations of golf club head covers and related methods and implementing components, sub-components, methods and sub-methods, it should be readily apparent that a number of modifications may be made without departing from the spirit thereof and that these implementations, implementing components, sub-components, methods and sub-methods may be applied to other golf club head covers with liners and related methods.

What is claimed is:

1. A golf club head cover comprising:

a body portion defining an internal cavity for receiving a golf club head, the internal cavity exposed at an opening in the body portion;

a flap coupled to the body portion and configured to cover the opening of the body portion;

a guide strip coupled to the flap;

a strap holder configured to move along the guide strip slidably coupled to the guide strip; and a strap coupled at an end of the strap holder, wherein the strap is configured to secure the flap over the opening through coupling to a front face of the body portion.

2. The cover of claim 1, wherein the front face comprises a recess along an open edge of the front face.

3. The cover of claim 1, wherein the front face comprises a re-entrant opening in an open edge of the front face.

4. The cover of claim 1, wherein the strap comprises a magnet and the front face comprises one or more magnets therein, wherein the magnet of the strap is configured to magnetically couple to the one or more magnets of the front face.

5. The cover of claim 4, wherein the magnet of the strap is comprised in the strap and the one or more magnets of the front face are comprised in a pocket, wherein the pocket is one of coupled in the front face, coupled on an outside of the front face, or coupled on an inside of the front face.

6. The cover of claim 4, wherein the magnet of the strap is within the strap and the one or more magnets of the front face is slidably retained within a pocket, wherein the pocket is one of coupled in the front face, on the outside of the front face, or on the inside of the front face.

7. The cover of claim 1, wherein the guide strip is a cylindrical guide strip.

8. The cover of claim 1, wherein the strap is configured to secure to a front face of the body portion using hook and loop fasteners.

9. A golf club head cover comprising:

a body portion defining an internal cavity for receiving a golf club head, the internal cavity exposed at an opening in the body portion, wherein the body portion comprises a front face comprising a strip of hook and loop fasteners extending across a portion of the front face;

a flap coupled to body portion and configured to cover an opening of the body portion;

a guide strip coupled to the flap;

a strap holder configured to move along the guide strip slidably coupled to the guide strip; and a strap coupled to the end of the strap holder comprising a patch of hook and loop fasteners, wherein the patch of hook and loop fasteners is configured to secure to a plurality of locations along the strip of hook and loop fasteners of the front face.

10. The cover of claim 9, wherein the front face comprises a recess along an open edge of the front face.

11. The cover of claim 9, wherein the front face comprises a re-entrant opening in an open edge of the front face.

12. The cover of claim 9, wherein the guide strip is a cylindrical guide strip.

* * * * *